US006441749B1

(12) United States Patent
Edwards

(10) Patent No.: US 6,441,749 B1
(45) Date of Patent: Aug. 27, 2002

(54) INTERACTIVE AUTOMATED TRAFFIC CONTROL SYSTEM

(76) Inventor: Leonard A. Edwards, 3040 Dartmoth St., Corona, CA (US) 92879

( * ) Notice: Subject to any disclaimer, the term of this patent is extended or adjusted under 35 U.S.C. 154(b) by 0 days.

(21) Appl. No.: 09/792,565

(22) Filed: Feb. 23, 2001

Related U.S. Application Data

(60) Provisional application No. 60/184,388, filed on Feb. 23, 2000.

(51) Int. Cl.[7] ..... G08G 1/00

(52) U.S. Cl. ..... 340/902; 340/906

(58) Field of Search ..... 340/901, 902, 340/904, 906, 907

(56) References Cited

U.S. PATENT DOCUMENTS

| | | | | | |
|---|---|---|---|---|---|
| 4,775,865 | A | * | 10/1988 | Smith et al. | 340/906 |
| 5,187,476 | A | * | 2/1993 | Hamer | 340/906 |
| 5,717,391 | A | * | 2/1998 | Rodriguez | 340/902 |
| 5,889,475 | A | * | 3/1999 | Klosinski et al. | 340/902 |

* cited by examiner

*Primary Examiner*—Daniel J. Wu
(74) *Attorney, Agent, or Firm*—Joseph N. Breaux

(57) ABSTRACT

An electronic warning signal device that includes a receive/warning light unit attached to an existing traffic signal and a transmitter carried by an emergency vehicle that is tuned to and transmits an activating signal to activate the warning light to assist the emergency vehicle in passing safely through an intersection. The receiver further includes a reset circuit having a timer element that is triggered by a reset signal sent from the transmitter once the emergency unit has traveled through the intersection.

1 Claim, 2 Drawing Sheets

INTERACTIVE AUTOMATED TRAFFIC CONTROL SYSTEM

CROSS-REFERENCE TO RELATED APPLICATIONS

This invention claims benefit of U.S. provisional application No. 60/184,388, which was filed on Feb. 23, 2000.

TECHNICAL FIELD

The present invention relates to traffic control signal systems and more particularly to a traffic control system that includes an interactive automated mechanism incorporating an electronic warning signal designed by for use by all types of emergency vehicles wherein the system includes a digital receiver/warning light unit attached to an existing traffic signal and a transmitter carried by an emergency vehicle that is tuned to and transmits an activating signal to activate the warning light to assist the emergency vehicle in passing safely through the intersection and that includes an integrated timer that would reset the traffic light once the vehicle has passed and a operator sends a reset signal from the transmitter.

BACKGROUND OF INVENTION

Emergency vehicles are often delayed in arriving at the scene of an emergency because traffic conditions prevent rapid transit of the roadways. It would be a benefit, therefore, to have a traffic control system that included an electronic warning system that incorporated a warning light having a digital receiver unit that was attachable to an existing traffic signal and a transmitter carried in emergency vehicles that is used to activate the light and alert traffic that an emergency vehicle is approaching so as to speed the emergency vehicle through the intersection to the emergency scene; the transmitter further including a deactivation signal receivable by the digital receiver for reestablishing operation of the traffic control light in the normal activation mode.

SUMMARY OF INVENTION

It is thus an object of the invention to provide an interactive automated traffic control system that includes an electronic warning signal assembly including a digital receiver/warning light unit attached to an existing traffic light signal and a transmitter carried by an emergency vehcile that is tuned to and transmits an activating signal to activate the warning light unit so as to assist the emergency vehicle to pass safely through an intersection and that includes an integrated timer that resets the existing traffic light signal upon receipt of a reset signal transmitted from the transmitter.

Accordingly, an interactive automated traffic control system is provided. The interactive automated traffic control system includes a digital receiver/warning light unit attached to an existing traffic light signal and a transmitter carried by the emergency vehicle that is tuned to and transmits an activating signal to activate the warning light unit so as to assist the emergency vehicle to pass safely through an intersection and that includes an integrated timer that resets the existing traffic light signal for a preset period after receipt of a reset signal transmitted from the transmitter.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
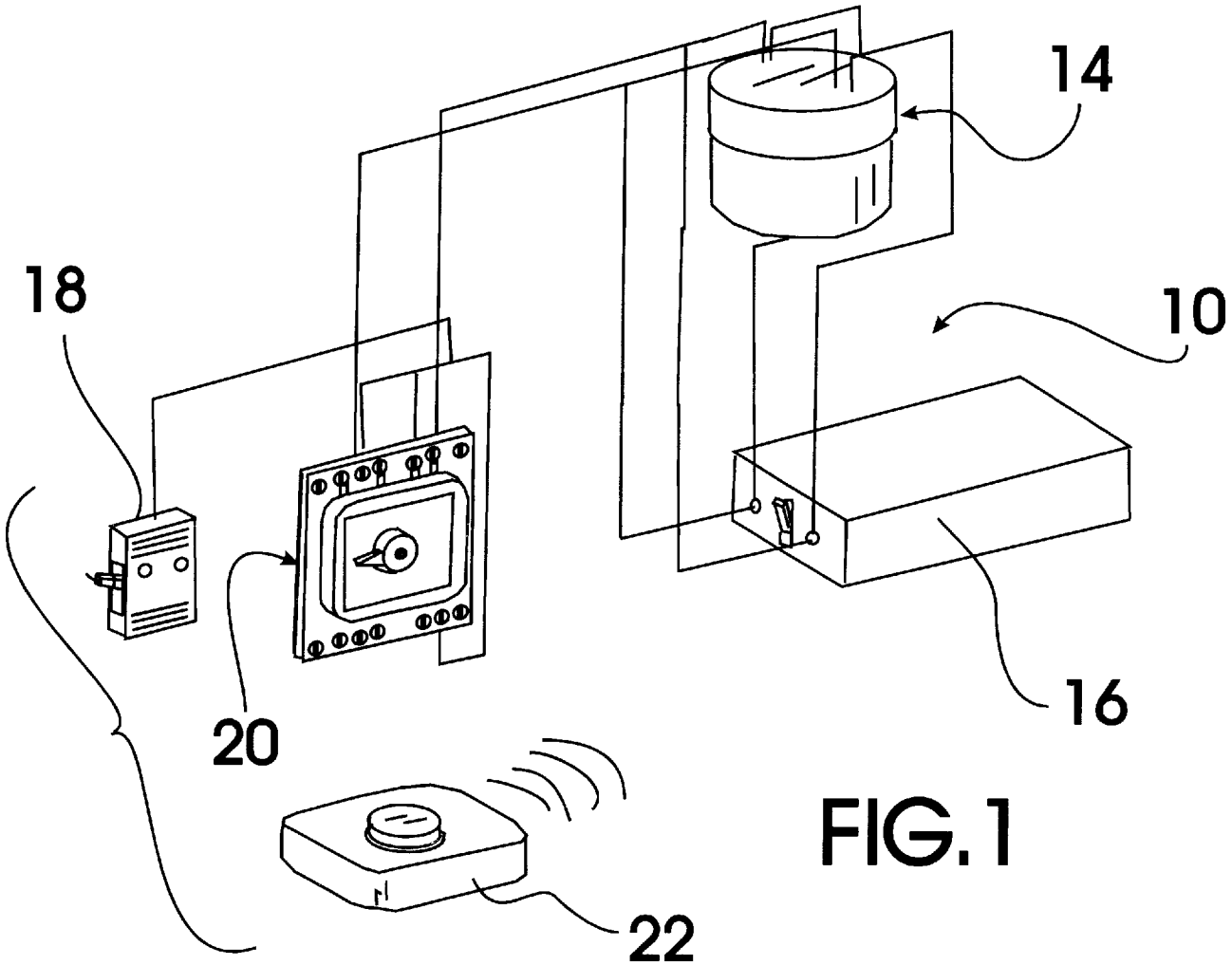
FIG. 1 shows an exemplary embodiment of the interactive automated traffic control system of the present invention.
Figure 2:
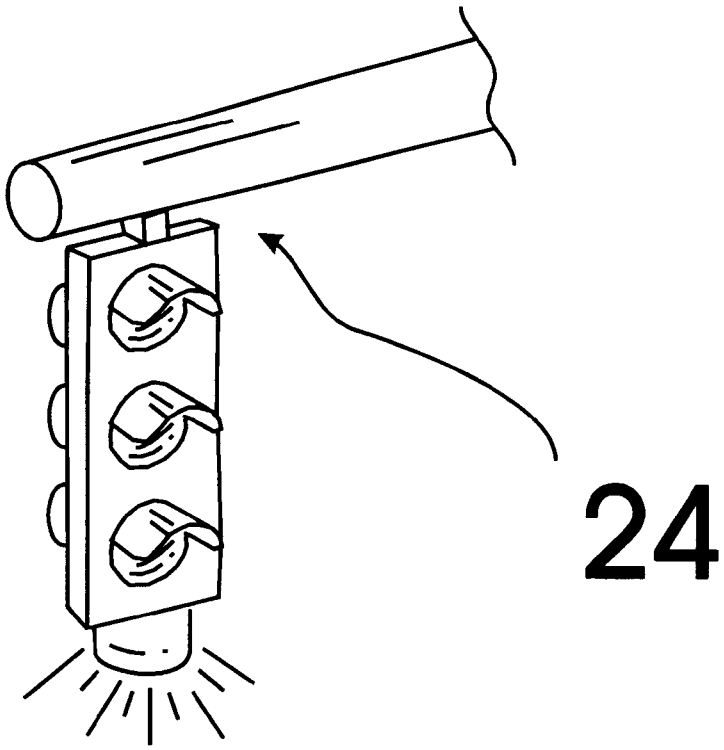
FIG. 2 shows a representative traffic light.

FIG. 1 shows an exemplary embodiment of the interactive automated traffic control system of the present invention generally designated 10. Interactive automated traffic control system 10 includes an electronic warning signal assembly including a warning light unit generally designated 14 having an AC to DC transformer 16, a receiver circuit 18 and a timer circuit 20 along with a transmitter 22 which is carried in the emergency vehicle. Receiver circuit 18 receives a signal from transmitter 22 to activate the warning light unit 14 to assist emergency vehicles in passing safely through an intersection. A warning light unit is attached to an existing traffic light signal 24 shown in FIG. 2. Once the emergency vehicle has passed the intersection, the transmitter sends a reset signal to the receiver 18 which activates a timer 20 which after the set time period has elapsed deactivates the warning light unit 14.

It can be seen from the preceding description that an interactive automated traffic control system has been provided.

It is noted that the embodiment of the interactive automated traffic control system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An interactive automated traffic control system comprising:

an electronic warning signal assembly including a digital receiver/warning light unit attached to an existing traffic light signal; and a transmitter carried by an emergency vehicle that is tuned to and transmits an activating signal to activate the warning light unit so as to assist the emergency vehicle to pass safely through an intersection and that includes an integrated timer that resets the existing traffic light signal upon receipt of a reset signal transmitted from the transmitter.

* * * * *